US009988183B2

(12) United States Patent
Ikeguchi et al.

(10) Patent No.: US 9,988,183 B2
(45) Date of Patent: Jun. 5, 2018

(54) TIRE-WHEEL TRANSPORT STRUCTURE

(71) Applicant: Kyoraku Co., Ltd., Kyoto-Shi, Kyoto (JP)

(72) Inventors: Naohiro Ikeguchi, Tokyo (JP); Masaaki Sueoka, Tokyo (JP)

(73) Assignee: KYORAKU CO., LTD., Kyoto-shi, Kyoto (JP)

( * ) Notice: Subject to any disclaimer, the term of this patent is extended or adjusted under 35 U.S.C. 154(b) by 0 days. days.

(21) Appl. No.: 15/501,531

(22) PCT Filed: Jul. 31, 2015

(86) PCT No.: PCT/JP2015/071754
§ 371 (c)(1),
(2) Date: Feb. 3, 2017

(87) PCT Pub. No.: WO2016/021486
PCT Pub. Date: Feb. 11, 2016

(65) Prior Publication Data

US 2017/0225827 A1 Aug. 10, 2017

(30) Foreign Application Priority Data

Aug. 6, 2014 (JP) ..... 2014-160533

(51) Int. Cl.
*B65D 19/44* (2006.01)
*B65D 19/00* (2006.01)
*B65D 85/06* (2006.01)

(52) U.S. Cl.
CPC ..... *B65D 19/44* (2013.01); *B65D 19/004* (2013.01); *B65D 85/06* (2013.01); *B65D 2519/00815* (2013.01); *B65D 2519/00965* (2013.01)

(58) Field of Classification Search
CPC ..... B65D 2519/00935; B65D 19/44; B65D 19/004; B65D 85/06
(Continued)

(56) References Cited

U.S. PATENT DOCUMENTS 3,495,705 A * 2/1970 Limbacher ..... B65D 71/70 206/599
3,636,888 A * 1/1972 Angelbeck, Jr. ... B65D 19/0014 108/53.1
(Continued)

FOREIGN PATENT DOCUMENTS

DE 4339445 C1 5/1995
DE 202012101784 U1 6/2012
(Continued)

OTHER PUBLICATIONS

PCT International Search Report dated Oct. 20, 2015 issued in corresponding PCT International Application No. PCT/JP2015/071754.

*Primary Examiner* — Jose V Chen
(74) *Attorney, Agent, or Firm* — TROUTMAN SANDERS LLP

(57) ABSTRACT

A tire-wheel transport pallet having engaging parts engaging the lower circumferential edge section of the rims of a plurality of tire wheels, and a mounting surface on which the tire wheels lying sideways are arranged; a partition plate prevents a horizontal positional shift, and interposed between an upper and a lower level of the tire wheels, which are stacked on the mounting surface in a plurality of levels; a lid covering the uppermost level of the tire wheels, and having, on its bottom surface, a plurality of wheel-position-determining concavities engaging the upper circumferential edge section of the rims of the tire wheels. Furthermore, the bottom surface of the pallet has a plurality of legs projecting downward, and the top surface of the lid has a plurality of
(Continued)

leg-position-determining concavities corresponding to the plurality of legs on the pallet, so to stack a plurality of units.

5 Claims, 12 Drawing Sheets

(58) Field of Classification Search
USPC ..... 108/53.1, 55.3, 53.3, 53.5, 55.5
See application file for complete search history.

(56) References Cited

U.S. PATENT DOCUMENTS 3,993,168 A * 11/1976 Kubick ..... B65D 19/0034 108/53.1
3,995,749 A * 12/1976 Haskins ..... B65D 19/0014 108/53.1
4,000,704 A * 1/1977 Griffin, Jr. ..... B65D 19/004 108/53.1
4,516,677 A * 5/1985 Rowland ..... B65D 71/70 108/53.1
4,653,651 A * 3/1987 Flum ..... A47F 7/281 108/53.1
4,667,823 A * 5/1987 Wolfe, Jr. ..... B65D 19/44 206/392
4,998,619 A * 3/1991 Sowa ..... B65D 71/0096 108/53.5
5,016,761 A * 5/1991 Stoddard ..... A47F 3/14 108/55.1
5,144,897 A * 9/1992 Avery ..... B65D 71/0096 108/55.3
5,390,789 A * 2/1995 Darby ..... B65D 19/44 206/391
5,636,753 A * 6/1997 Wilkinson ..... A47F 7/281 206/821
5,758,771 A * 6/1998 Rose ..... B65D 19/44 206/386
6,484,877 B1 * 11/2002 Murakami ..... B65D 19/44 108/55.3
6,530,476 B1 * 3/2003 Overholt ..... B65D 71/0096 108/55.3
6,659,019 B2 * 12/2003 Gruber ..... B65D 71/70 108/53.5
6,971,518 B1 * 12/2005 Lowry ..... B65D 19/385 108/53.1
7,546,921 B2 * 6/2009 Evans ..... B65D 71/72 206/391
9,010,255 B2 * 4/2015 Baltz ..... B65D 19/0004 108/57.13
9,688,436 B2 * 6/2017 Sakaguchi ..... B65D 19/0063
2004/0255827 A1 * 12/2004 de Barros, Jr. ..... B65D 19/44 108/55.1
2015/0108036 A1 * 4/2015 Sakaguchi ..... B65D 71/0096 206/597
2016/0122078 A1 * 5/2016 Clark ..... B65G 1/08 414/273
2016/0251114 A1 * 9/2016 Lee ..... B65D 19/44 108/55.3

FOREIGN PATENT DOCUMENTS

JP S60-120973 U 8/1985
JP H1072009 3/1998
JP 3318120 B2 8/2002
JP 3561875 B2 9/2004
JP 2014043270 A 3/2014

* cited by examiner

TIRE-WHEEL TRANSPORT STRUCTURE

CROSS-REFERENCE TO RELATED APPLICATIONS

This is a U.S. national phase application under 35 U.S.C. § 371 of International Patent Application No. PCT/JP2015/071754, filed on Jul. 31, 2015, and claims benefit of priority to Japanese Patent Application No. 2014-160533, filed Aug. 6, 2014. The entire contents of these applications are hereby incorporated by reference.

TECHNICAL FIELD

The present invention relates to a tire-wheel transport structure.

BACKGROUND

Various transport structures for transporting tire wheels such as aluminum wheels have been proposed (for example, see Japanese Patent No. 3318120).

Japanese Patent No. 3318120 discloses a pallet including a placing surface having annular grooves corresponding to plural types of automobile wheels having different diameters. On the pallet, the annular grooves corresponding to the respective diameters are configured by annular grooves and other types of annular grooves planarly overlapped with each other. According to the pallet of Japanese Patent No. 3318120, the wheels are transported with the wheels being fitted into the annular grooves corresponding to diameters of the respective wheels. This avoids displacement of the wheels, and enables to transport and store plural types of wheels having different sizes.

Japanese Patent No. 3561875 discloses a technique by which each stage of tire wheels stacked in multiple stages on a pallet is sandwiched by two support-fixing members capable of avoiding horizontal movement of the tire wheels. With this technique, it is possible to stack the tire wheels in multiple stages on the pallet, while avoiding the horizontal movement of the tire wheels.

Incidentally, recently, there are demands for further improvement in efficiency of transportation and storage of automobile parts. Thus, also for the tire-wheel transport structure, there is a demand for a technique for transporting and storing a larger number of tire wheels more efficiently.

SUMMARY

In view of the above-described circumstances, the present invention has been made. The present invention has an object to provide a tire-wheel transport structure as below. That is, the tire-wheel transport structure is configured to allow units to be stacked in multiple stages stably, where each of the units is constituted by tire wheels stacked in multiple stages on a single pallet. With such a tire-wheel transport structure, it is possible to transport and store a larger number of tire wheels more efficiently.

In order to achieve the above object, the present invention is understood by the following configurations.

(1) One aspect according to the present invention is a tire-wheel transport structure including: a pallet including a placing surface on which a plurality of tire wheels is placeable with the plurality of tire wheels laid on the tire wheels' sides and a plurality of engagement parts formed on the placing surface, the plurality of engagement parts being engageable with lower peripheries of rims of the plurality of tire wheels; a partition plate configured to be interposed between the plurality of tire wheels in an upper stage and the plurality of tire wheels in a lower stage, the plurality of tire wheels being stacked in multiple stages on the placing surface of the pallet, to avoid lateral displacement of the plurality of tire wheels in the upper stage and the plurality of tire wheels in the lower stage; and a lid configured to cover the plurality of tire wheels in an uppermost stage, the lid having a lower surface having a plurality of wheel positioning recesses being engageable with upper peripheries of the rims of the plurality of tire wheels. The pallet has a lower surface having a plurality of legs projected downwardly. The lid has an upper surface having a plurality of leg positioning recesses respectively corresponding to the plurality of legs of the pallet so that a plurality of units is stackable, where each of the plurality of units is constituted by the pallet, the plurality of tire wheels stacked in multiple stages, the partition plate, and the lid.

(2) In the configuration of the above described (1), the lid may be made of a hollow resin molding integrally having a double-walled structure including an upper wall and a lower wall. The plurality of leg positioning recesses may be provided on the upper wall in such a manner that the plurality of leg positioning recesses is depressed toward the lower wall. The plurality of wheel positioning recesses may be provided on the lower wall in such a manner that the plurality of wheel positioning recesses is depressed toward the upper wall.

(3) In the configuration of the above described (1) or (2), the plurality of wheel positioning recesses may be grooves respectively corresponding to the upper peripheries of the rims.

The present invention can provide a tire-wheel transport structure as below. That is, the tire-wheel transport structure is configured to allow units to be stacked in a larger number of multiple stages stably, where each of the units is constituted by tire wheels stacked in multiple stages on a single pallet. With such a tire-wheel transport structure, it is possible to transport and store a larger number of tire wheels more efficiently.

DETAILED DESCRIPTION

Examples

With reference to the drawings, the following provides a detailed description of examples of the present invention (hereinafter, referred to as "examples"). Throughout the description of the examples, identical elements are given identical reference signs.

(Overall Configuration of Tire-Wheel Transport Structure 10)

Figure 1:
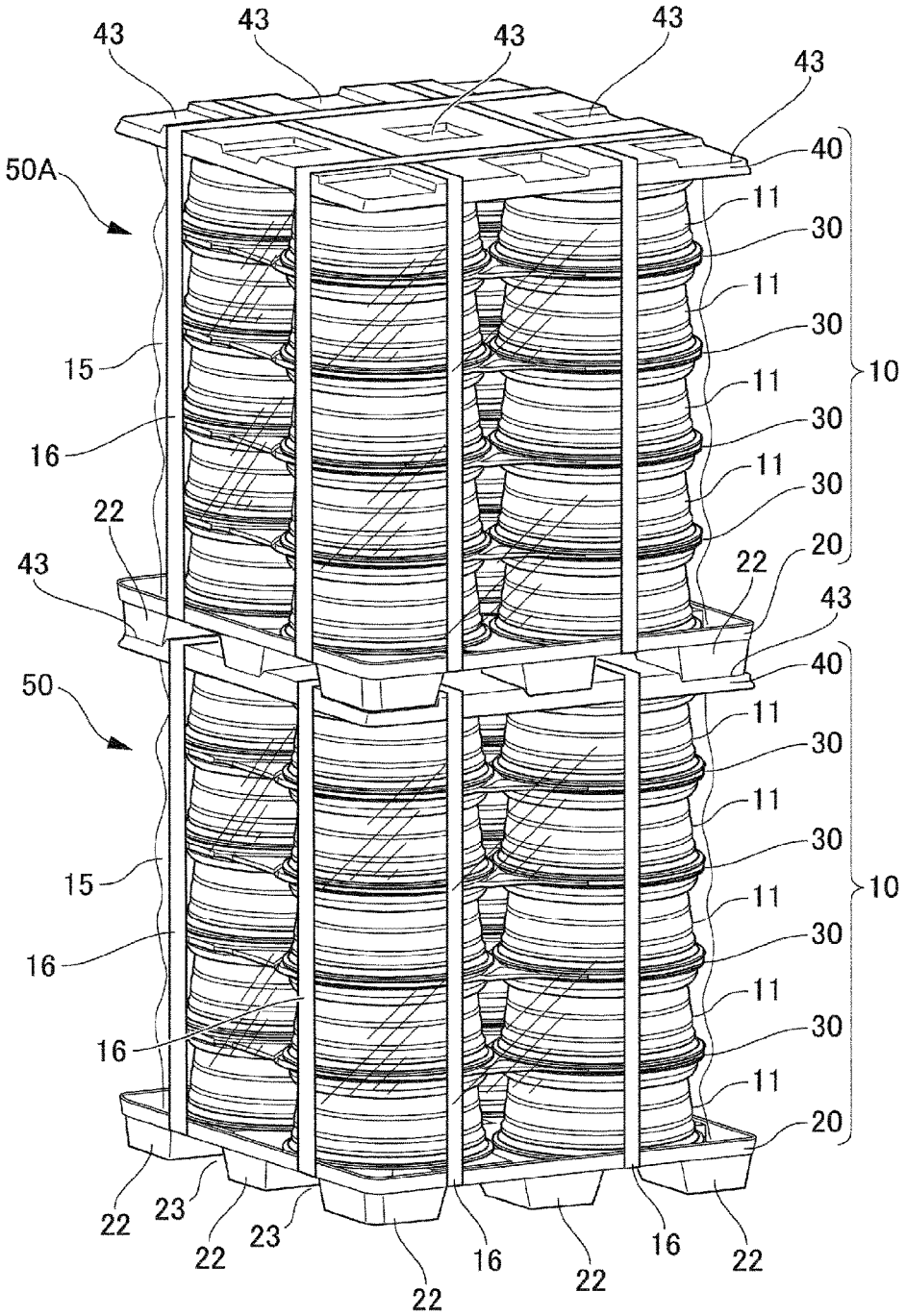
FIG. 1 is a view for illustrating an example of use of a tire-wheel transport structure according to an example of the present invention, and is a perspective view of two units that are stacked.

With reference to FIG. 1, the following describes an overall configuration of a tire-wheel transport structure 10. As shown in FIG. 1, the tire-wheel transport structure 10 is a logistics material for use in transportation and storage of tire wheels 11 such as aluminum wheels. The tire-wheel transport structure 10 includes a pallet 20, a partition plate 30, and a lid 40. On the pallet 20, a plurality of tire wheels 11 is to be placed with the tire wheels 11 laid on their sides, i.e., with axial lines 13 of shaft holes 12 of the tire wheels 11 aligned with a vertical direction (see FIG. 2). The partition plate 30 is configured to be interposed between the tire wheels 11 in an upper stage and the tire wheels 11 in a lower stage, tire wheels 11 being stacked in a multiple stages on the pallet 20. The lid 40 is configured to cover a plurality of tire wheels 11 of an uppermost stage.

According to the tire-wheel transport structure 10, one unit 50 can be constituted by the pallet 20, the tire wheels 11 stacked in multiple stages on the pallet 20, a plurality of partition plates 30, and the lid 40. Further, on the lid 40 of the one unit 50, other units 50A may be stacked in multiple stages. As an example, FIG. 1 illustrates two units 50 and 50A stacked in two stages.

(Configuration of Pallet 20)

Figure 2:
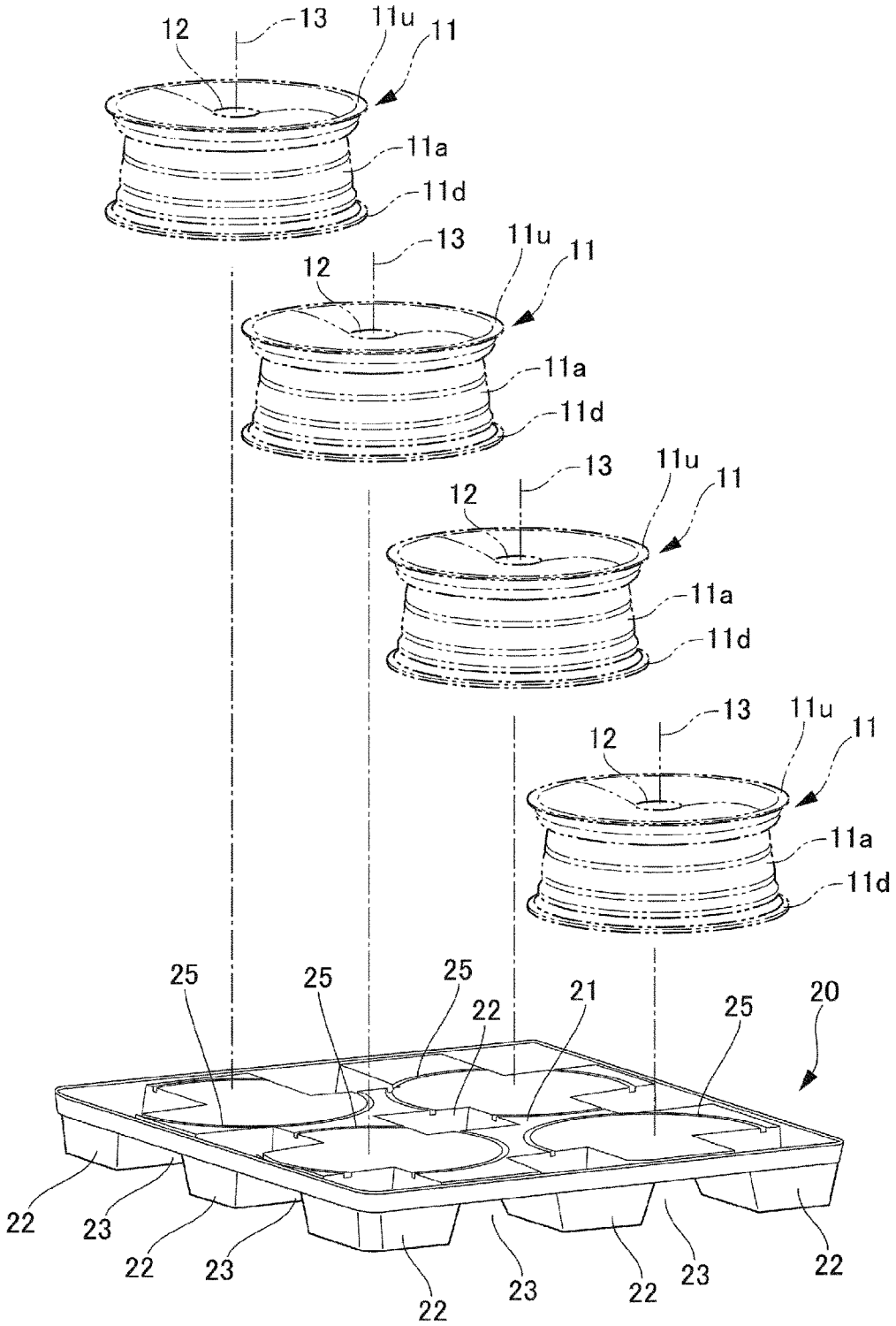
FIG. 2 is a perspective view of a pallet shown in FIG. 1.

Next, with reference to FIG. 2, the following describes a configuration of the pallet 20. The pallet 20 is made of a synthetic resin, and is formed to have a plane having a substantially quadrangle shape, as shown in FIG. 2. The pallet 20 has a placing surface 21, on which a plurality of tire wheels 11 (in this example, four tire wheels 11) is to be arranged and placed. Meanwhile, the pallet 20 has a lower surface having a plurality of legs 22 projected downwardly. Each of the legs 22 is a recess depressed downwardly from the placing surface 21 side. In this example, nine legs 22 are arranged at lattice points on the lower surface of the pallet 20, which has a substantially quadrangle shape. This example shows a configuration including a fork insertion portion 23, disposed in a separation part between two adjacent ones of the legs 22, into which a folk (claw) of a forklift is to be inserted.

Further, the placing surface 21 has a plurality of engagement parts 25. The engagement parts 25 are engageable with lower peripheries 11*d* of rims 11*a* of the respective plurality of tire wheels 11. The plurality of engagement parts 25 is annular grooves formed on the placing surface 21 except on the legs 22 in such a manner that the engagement parts 25 are not overlapped with each other.

(Configuration of Partition Plate 30)

Figure 3:
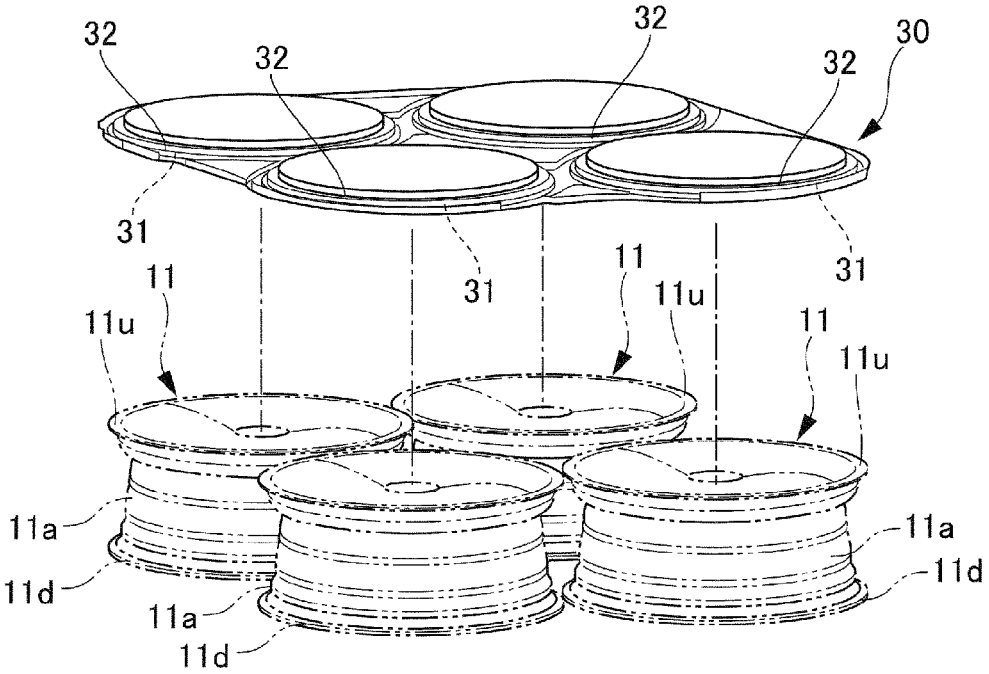
FIG. 3 is a perspective view of a partition plate shown in FIG. 1.

Next, with reference with FIG. 3, the following describes a configuration of the partition plate 30. As shown in FIG. 2, the partition plate 30 is formed to have a plane having a substantially quadrangle shape. The partition plate 30 has a plurality of lower engagement parts 31, which is annular and corresponds to the plurality of tire wheels 11 arranged on the pallet 20. Each of the lower engagement parts 31 is an annular groove that is depressed from a lower surface side of the partition plate 30 toward an upper surface of the partition plate 30. The lower engagement parts 31 are engageable with upper peripheries 11*u* of the rims 11*a* of the respective tire wheels 11. Further, the partition plate 30 has a plurality of upper engagement parts 32, which is annular and is arranged concentrically with the lower engagement parts 31. Each of the upper engagement parts 32 is an annular groove that is depressed from the upper surface side of the partition plate 30 toward the lower surface of the partition plate 30. The upper engagement parts 32 are engageable with lower peripheries 11*d* of rims 11*a* of respective tire wheels 11 to be placed on the partition plate 30.

(Configuration of Lid 40)

Figure 4A:
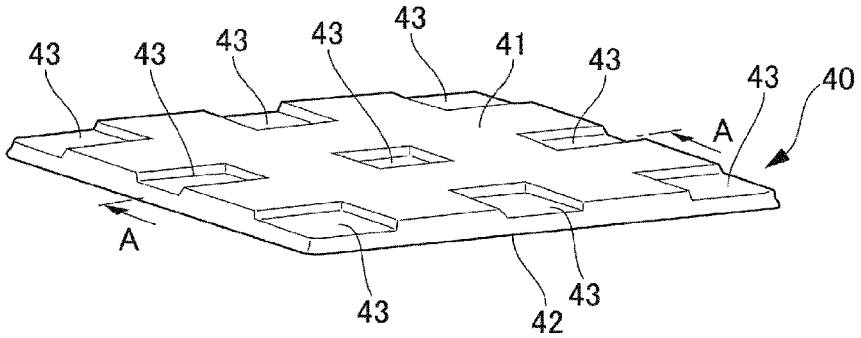
FIG. 4(*a*) is a perspective view of a lid shown in FIG. 1 from obliquely above, FIG. 4(*b*) is a perspective view of a lid shown in FIG. 1 from obliquely bottom, and FIG. 4(*c*) is a cross-sectional view of a lid shown in FIG. 1 taken along line A-A of FIG. 4(*a*).
Figure 4B:
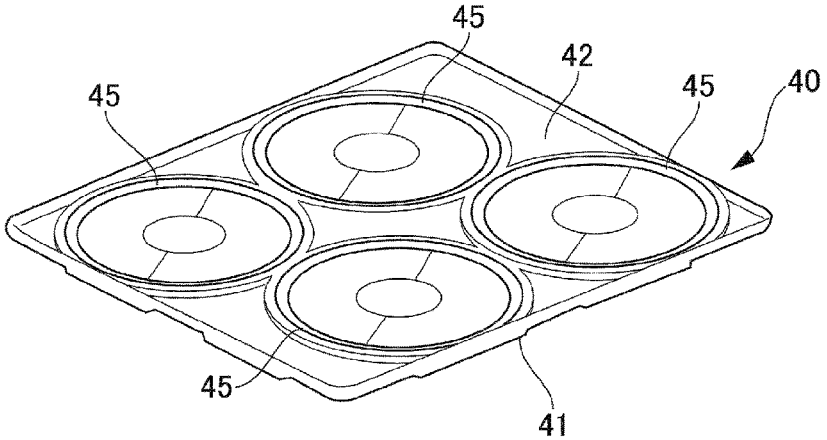
Figure 4C:
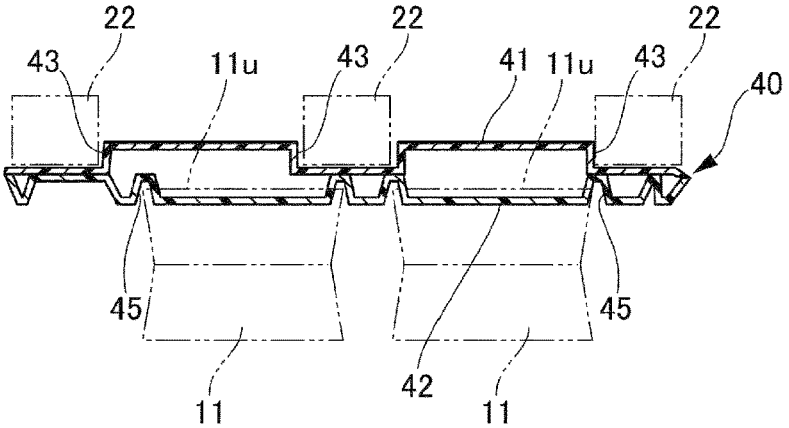

Next, with reference with FIG. 4, the following describes a configuration of the lid 40. As shown in FIG. 4(*a*), the lid 40 is a hollow resin molding integrally having a double-walled structure including an upper wall 41 and a lower wall 42. The lid 40 has a plane having a substantially quadrangle shape. This resin molding can be molded by any method. For example, the hollow resin molding (lid 40) can be formed by blow molding. Further, as a molding material of the lid 40, a polyolefin resin exemplified by polyethylene and polypropylene can be used.

The upper wall 41 has a plurality of leg positioning recesses 43. Further, as shown in FIG. 4(*b*), the lower wall 42 has a plurality of wheel positioning recesses 45.

As shown in FIG. 4(*c*), each of the leg positioning recesses 43 is depressed from the upper wall 41 side toward the lower wall 42. The leg positioning recesses 43 are engageable with legs 22 of a pallet 20 coming from above. Meanwhile, each of the wheel positioning recesses 45 is an annular groove that is depressed from the lower wall 42 side toward the upper wall 41. The wheel positioning recesses 45 respectively correspond to the upper peripheries 11*u* of the tire wheels 11 of the uppermost stage in the unit 50 (see FIG. 1), and are engageable with the upper peripheries 11*u*.

(Working Procedure of Loading Tire Wheels 11)

Next, with reference to FIGS. 5 to 10, the following describes procedures of loading tire wheels 11.

Figure 5:
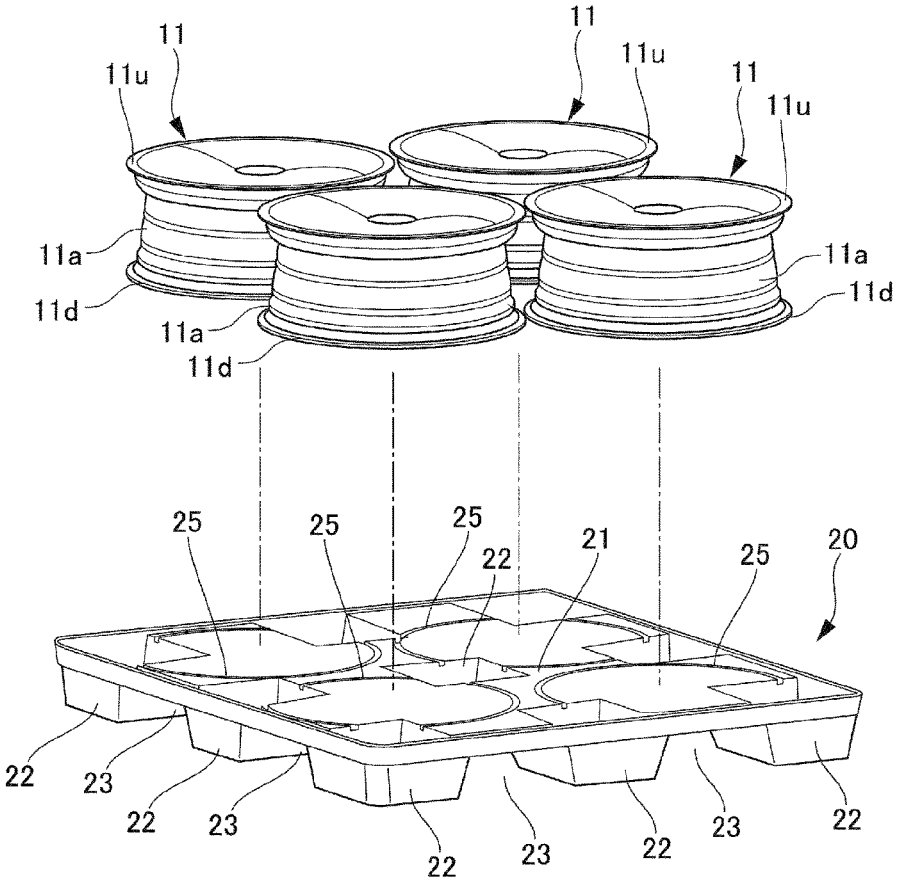
FIG. 5 is a view for illustrating a working procedure of placing tire wheels on the pallet.

As shown in FIG. 5, first, a plurality of tire wheels 11 (in this example, four tire wheels 11) is arranged and placed on a placing surface 21 of a pallet 20 with the tire wheels 11 laid on their sides. The arranging and placing are performed such that lower peripheries 11*d* of rims 11*a* are engaged with engagement parts 25. This causes the tire wheels 11 to be positioned in correct positions in the pallet 20, and avoids lateral displacement of each tire wheel 11.

Figure 6:
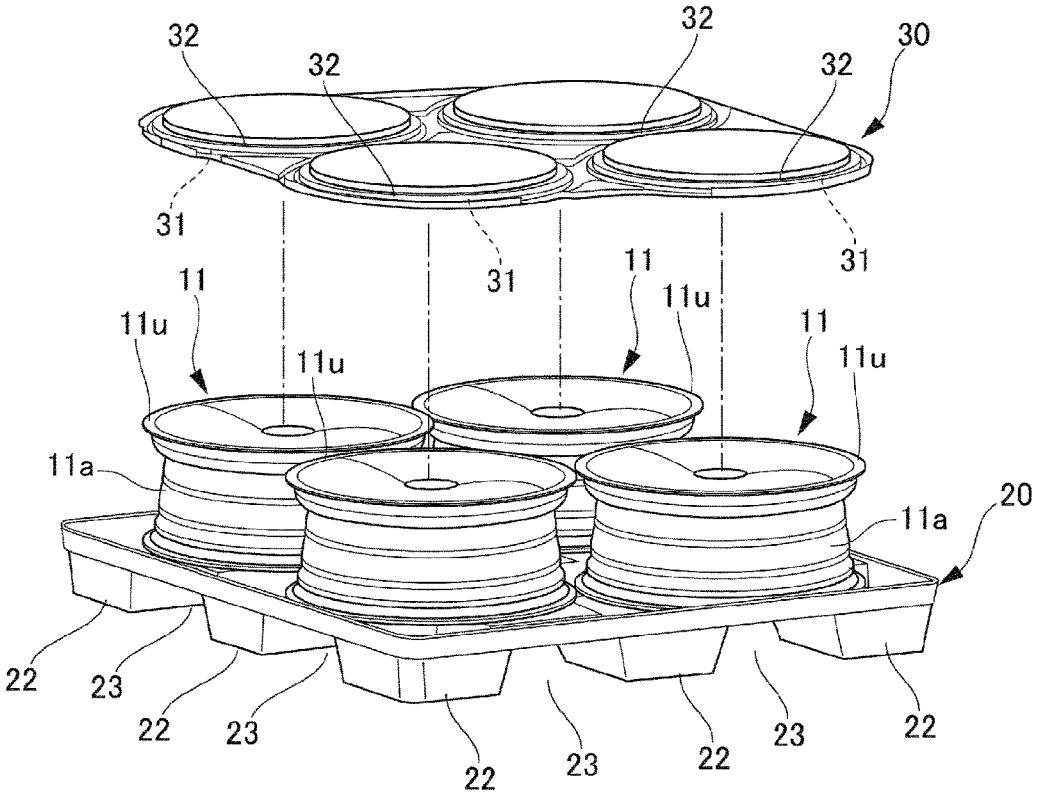
FIG. 6 is a view for illustrating a working procedure of placing a partition plate on the tire wheels.

Next, as shown in FIG. 6, a partition plate 30 is placed from above on the plurality of tire wheels 11 arranged on the pallet 20. The placing of the partition plate 30 is performed such that lower engagement parts 31 of the partition plate 30 are respectively engaged with upper peripheries 11*u* of the rims 11*a*.

Figure 7:
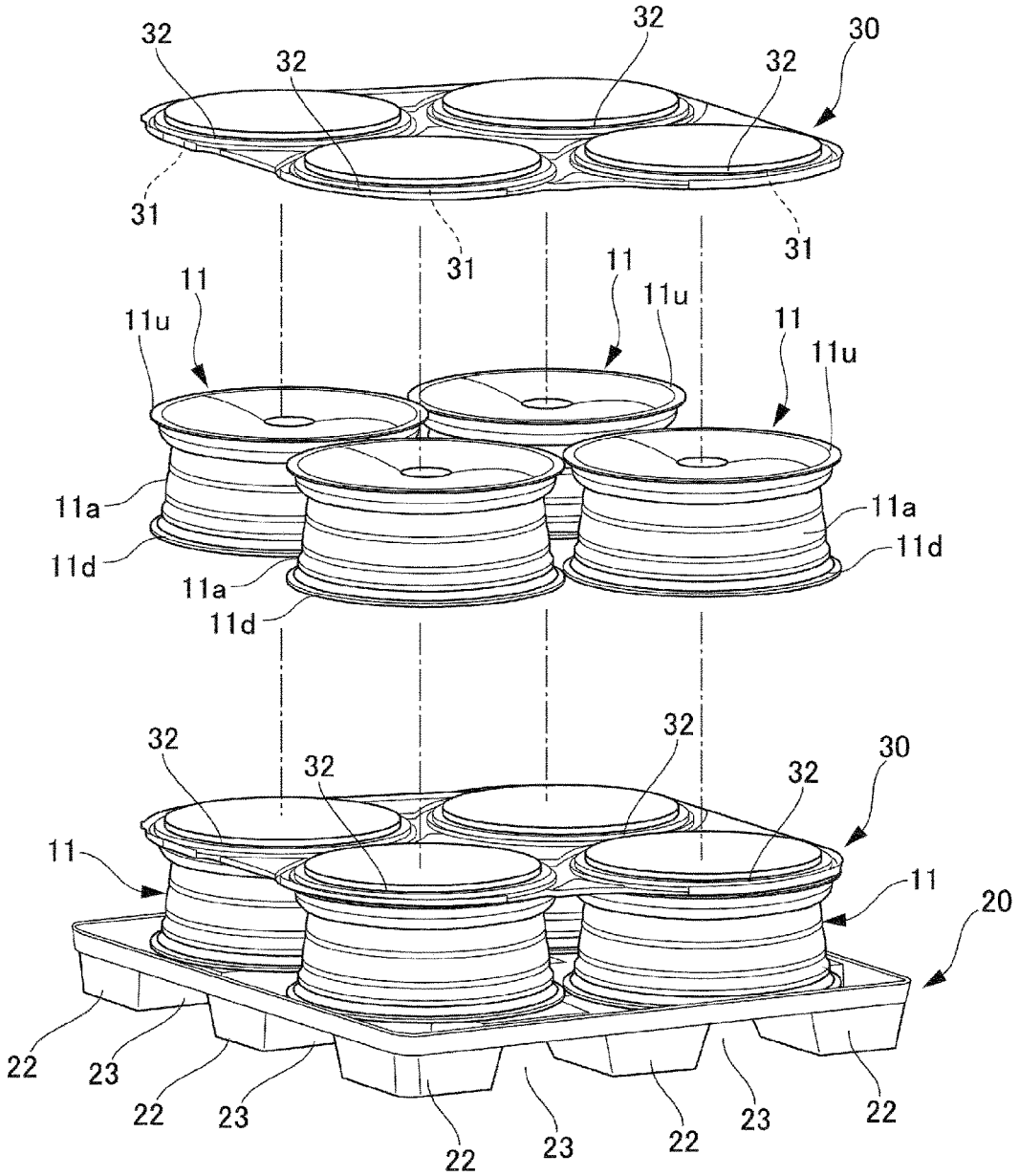
FIG. 7 is a view for illustrating a working procedure of further placing tire wheels and a partition plate on the partition plate.

Further, as shown in FIG. 7, a plurality of tire wheels 11 is arranged and placed on the partition plate 30 with the plurality of tire wheels 11 laid on their sides. The arranging and placing are performed such that lower peripheries 11*d* of rims 11*a* are engaged with upper engagement parts 32 of the partition plate 30. Consequently, in the partition plate 30, the lower engagement parts 31 are engaged with the plurality of tire wheels 11 in the lower stage, and the upper engagement parts 32 are engaged with the plurality of tire wheels 11 in the upper stage. This avoids lateral displacement of the tire wheels 11 in the lower stage and the tire wheels 11 in the upper stage.

Figure 8:
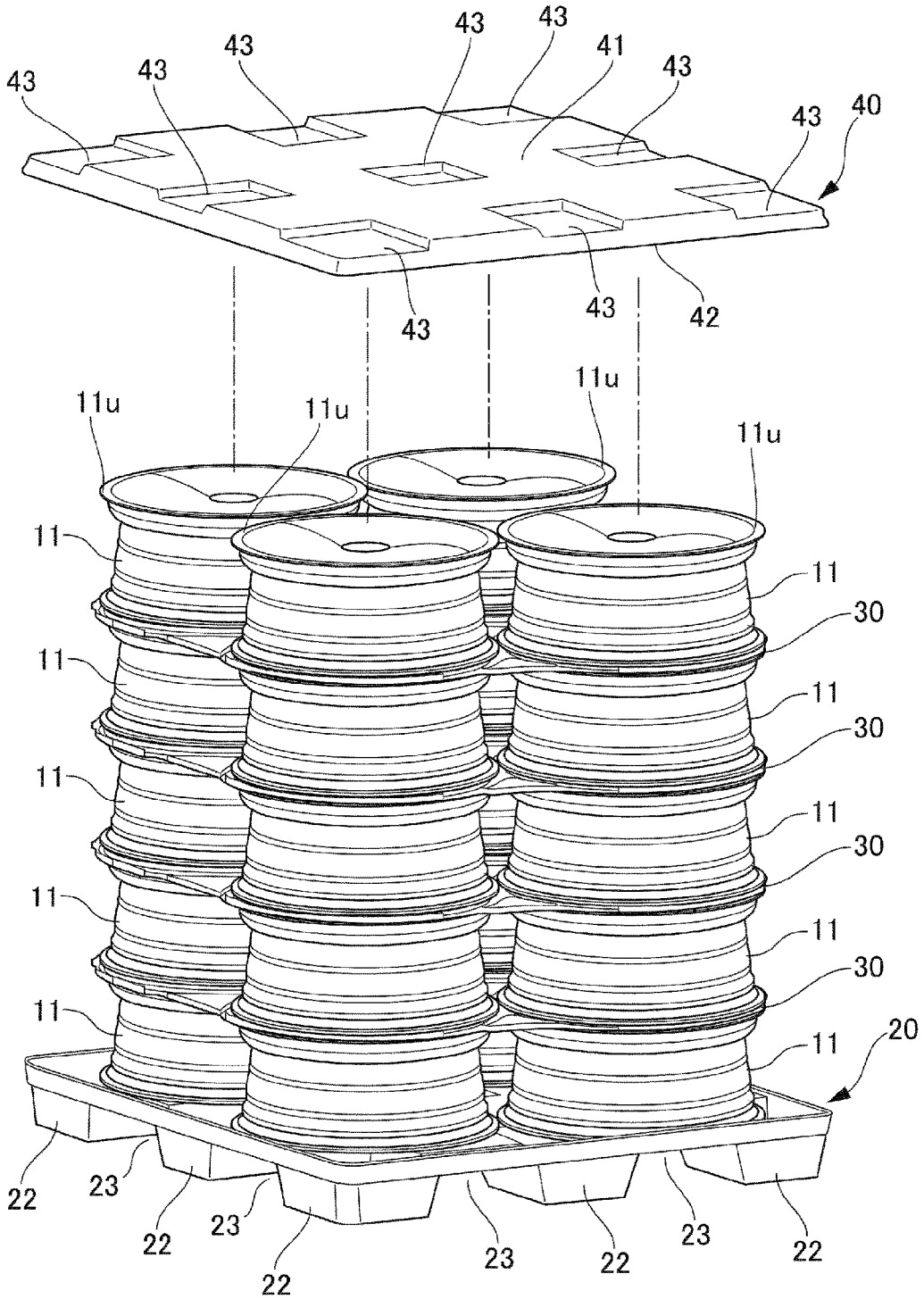
FIG. 8 is a view for illustrating a working procedure of placing a lid on the tire wheels.

Furthermore, as shown in FIG. 8, a partition plate 30 is placed on the plurality of tire wheels 11 in the upper stage from above. In this manner, a plurality of tire wheels 11 is stacked in a predetermined number of stages (in this example, five stages) via partition plates 30. Then, a lid 40 is put on the plurality of tire wheels 11 in an uppermost stage. The putting of the lid 40 is performed such that wheel positioning recesses 45 of the lid 40 (see FIG. 4(*b*)) are respectively engaged with upper peripheries 11*u* of rims 11*a*.

Figure 9:
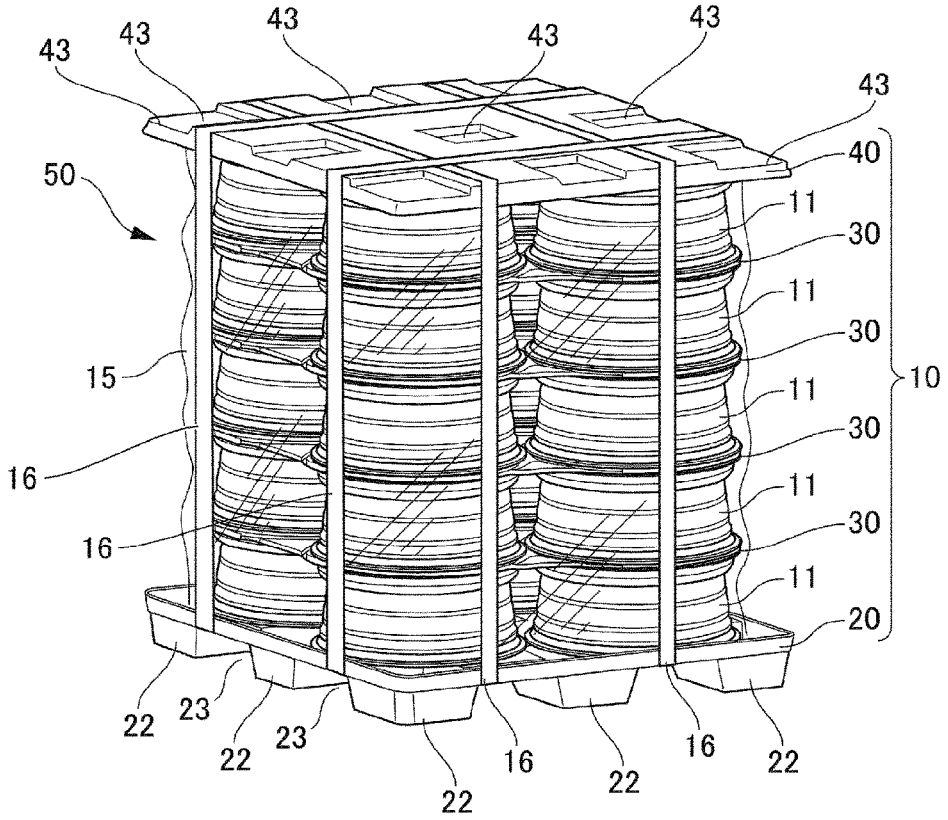
FIG. 9 is a perspective view of a packing style of a unit in which the pallet and the lid are bound.

Moreover, as shown in FIG. 9, a stretch film 15 is wound along the entire circumference of the tire wheels 11 stacked in multiple stages. Then, the pallet 20 and the lid 40 are bound with a binding band 16, so that the stacked tire wheels 11 are sandwiched between the pallet 20 and the lid 40 to be fixed. Consequently, one unit 50 is constituted by the pallet 20, the tire wheels 11 stacked in multiple stages, the partition plates 30, and the lid 40.

Figure 10:
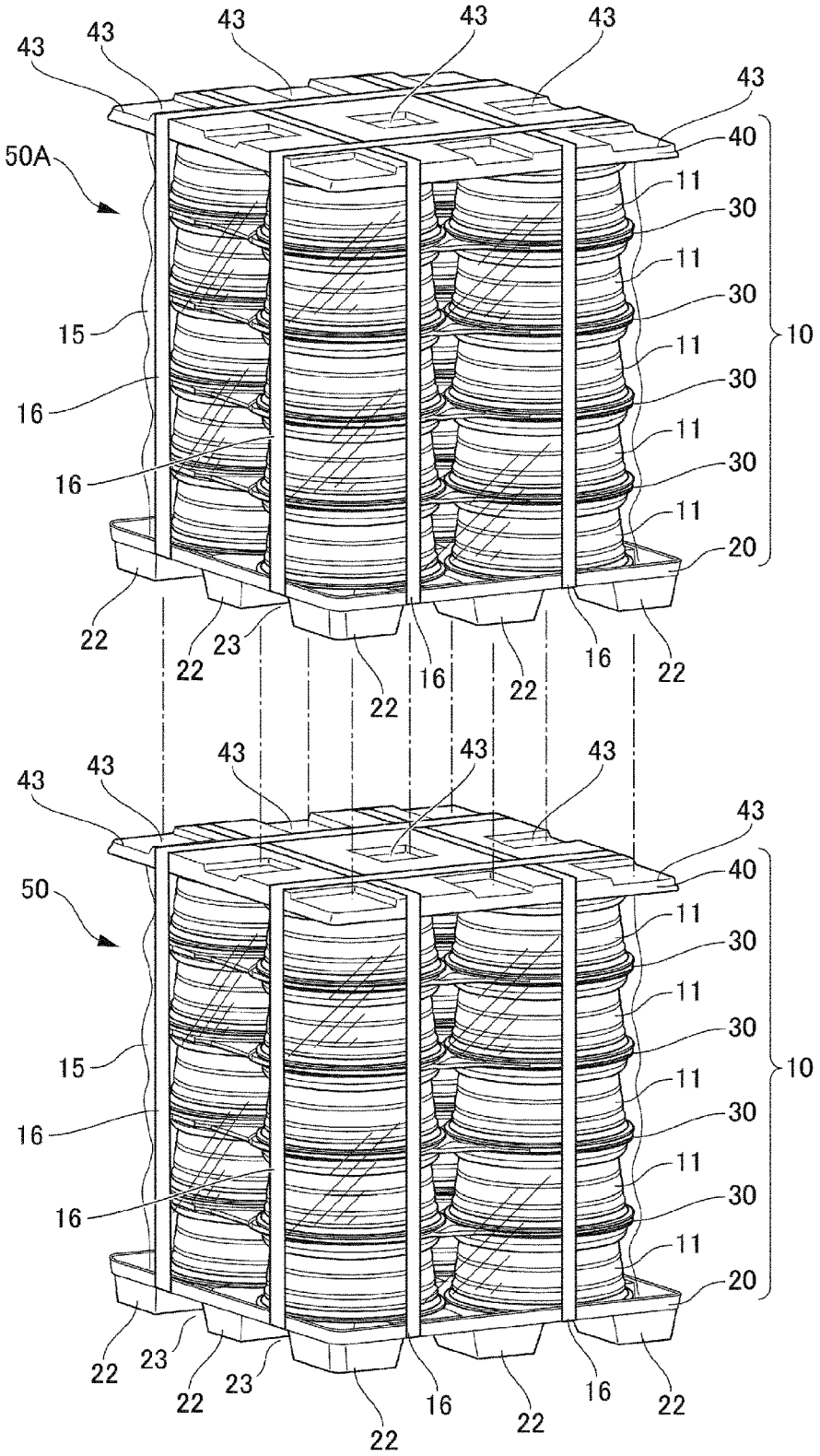
FIG. 10 is a view for illustrating a working procedure of stacking, on the lid, a pallet of another unit.

Then, as shown in FIG. 10, on the one unit 50, another unit 50A is stacked. The stacking is performed such that legs 22 of a pallet 20 of another unit 50A are engaged with leg positioning recesses 43 of the lid 40 of the one unit 50. Consequently, the units 50 and 50A stacked in multiple stages are obtained.

(Effects of Tire-Wheel Transport Structure 10)

The following describes effects of the above-described tire-wheel transport structure 10. According to the tire-wheel transport structure 10, the lid 40 has an upper surface having the leg positioning recesses 43. By engaging the leg positioning recesses 43 with legs 22 of a pallet 20 of another unit 50A, the plurality of units 50 and 50A can be stacked stably. As a result, it is possible to transport and store a larger number of tire wheels 11 more efficiently.

(Modification of Tire-Wheel Transport Structure 10)

Figure 11A:
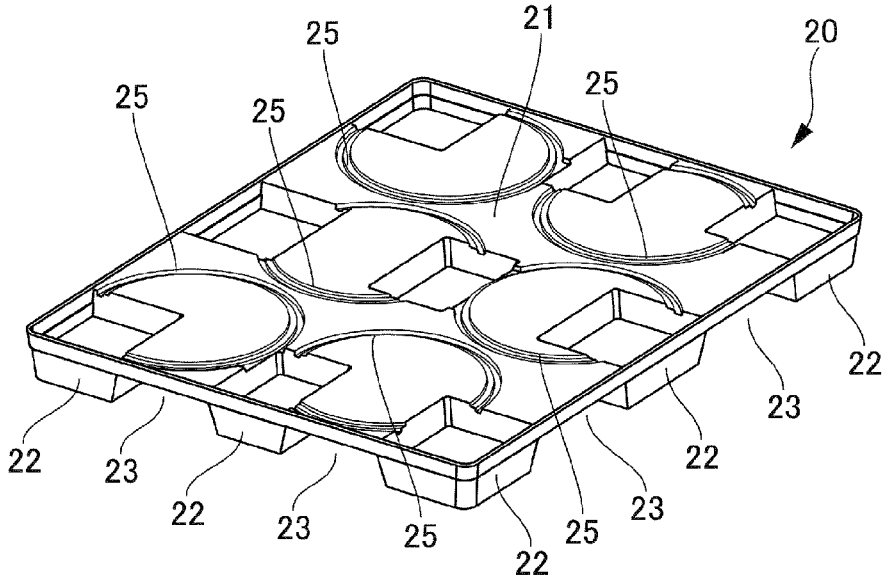
FIG. 11(*a*) is a perspective view of a pallet of a modification of the example from obliquely above and FIG. 11(*b*) is a perspective view of a pallet of a modification of the example from obliquely bottom.
Figure 11B:
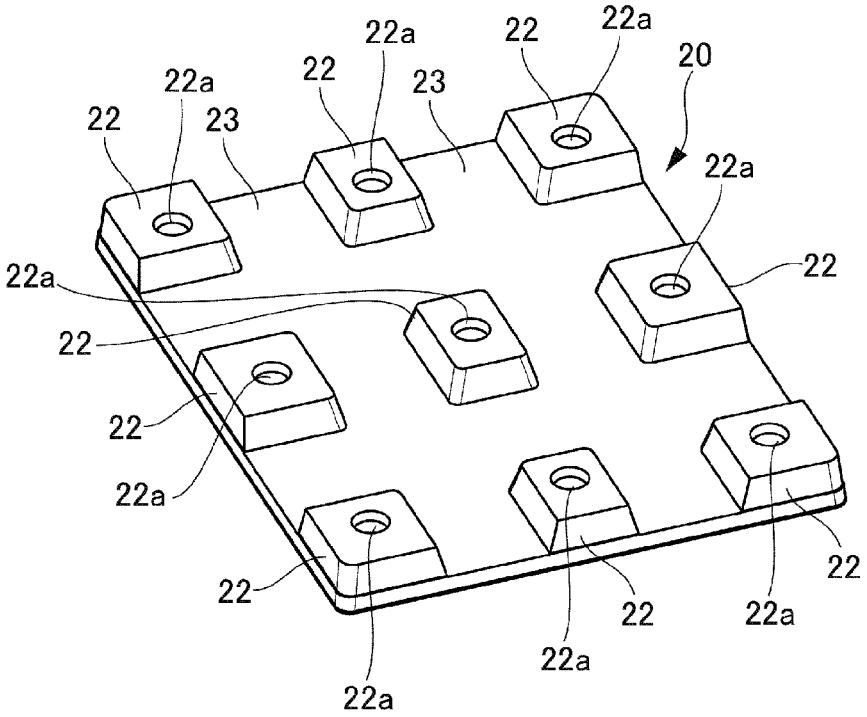
Figure 12A:
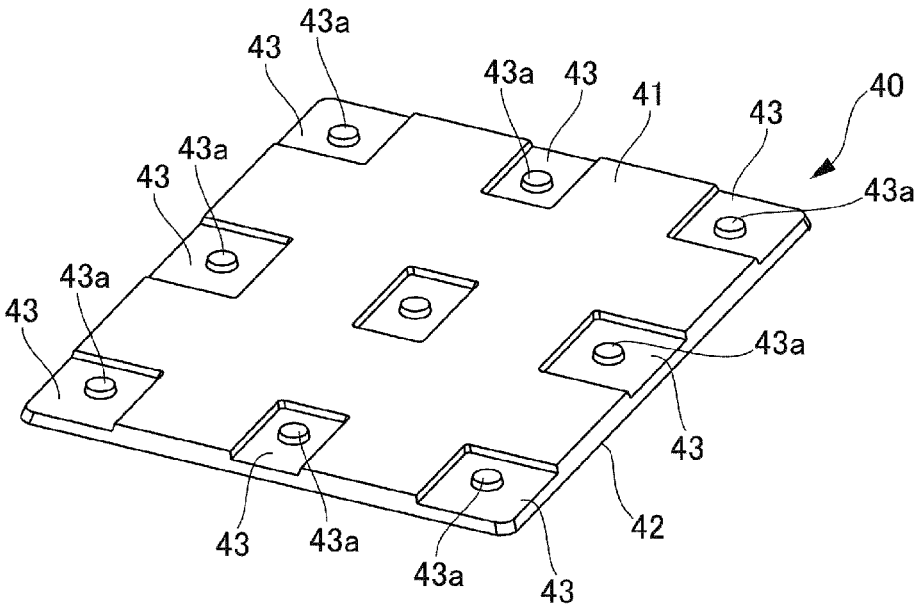
FIG. 12(*a*) is a perspective view of a lid of the modification of the example from obliquely above and FIG. 12(*b*) is a perspective view of a lid of the modification of the example from obliquely bottom.
Figure 12B:
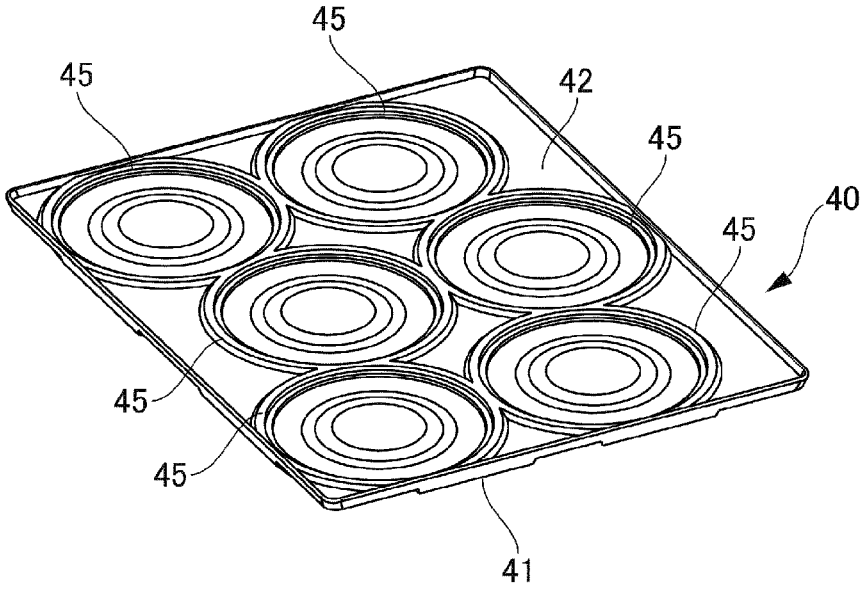

Next, with reference to FIGS. 11 and 12, the following describes a modification of the tire-wheel transport structure 10.

As shown in FIG. 11(*a*), a pallet 20 of the modification is configured such that six tire wheels 11 are to be placed thereon, and the pallet 20 has a placing surface 21 having six engagement parts 25. Further, as shown in FIG. 11(*b*), the pallet 20 has legs 22 each having a bottom surface having an engagement recess 22*a* that is circular in cross-section.

Meanwhile, as shown in FIG. 12(*a*), a lid 40 has leg positioning recesses 43 each having a center part having a projection 43*a*, which is projected upwardly. The projection 43*a* is a protrusion that is circular in cross-section and is engageable with the engagement recess 22*a* of the leg 22 (see FIG. 11(*b*)). Further, as shown in FIG. 12(*b*), the lid 40 has a lower wall 42 having six wheel positioning recesses 45 respectively corresponding to the six tire wheels 11.

According to the modification, in the process of engaging leg positioning recesses 43 of a lid 40 of one unit with legs 22 of a pallet 20 of another unit, it is possible to engage projections 43*a* of the leg positioning recesses 43 with engagement recesses 22*a* of the legs 22. This further enhances engagement strength between the legs 22 and the leg positioning recesses 43. Consequently, it is possible to stack a plurality of units more stably.

In the foregoing description, the present invention has been explained in relation to the examples. However, needless to say, the technical scope of the present invention is not limited to the descriptions of the examples. Persons skilled in the art would readily understand that various modifications and/or variations can be made in the examples. Further, it is clear from the claims that other examples including such modifications and/or variations are also encompassed in the technical scope of the present disclosure.

The invention claimed is:

1. A tire-wheel transport structure comprising:

a pallet including a placing surface on which a plurality of tire wheels is placeable with the plurality of tire wheels laid on the tire wheels' sides and a plurality of engagement parts formed on the placing surface, the plurality of engagement parts being engageable with lower peripheries of rims of the plurality of tire wheels;

a partition plate configured to be interposed between the plurality of tire wheels in an upper stage and the plurality of tire wheels in a lower stage, the plurality of tire wheels being stacked in multiple stages on the placing surface of the pallet, to avoid lateral displacement of the plurality of tire wheels in the upper stage and the plurality of tire wheels in the lower stage; and a lid configured to cover the plurality of tire wheels in an uppermost stage, the lid having a lower surface having a plurality of wheel positioning recesses being engageable with upper peripheries of the rims of the plurality of tire wheels, wherein the pallet has a lower surface having a plurality of legs projected downwardly, the lid has an upper surface having a plurality of leg positioning recesses respectively correspondingly shaped to the plurality of legs of the pallet so that a plurality of units is stackable, where each of the plurality of units is constituted by the pallet, the plurality of tire wheels stacked in multiple stages, the partition plate, and the lid, and a depth of the leg positioning recesses is less than a height of the legs projecting from the pallet.

2. The tire-wheel transport structure according to claim 1, wherein the lid is made of a hollow resin molding integrally having a double-walled structure including an upper wall and a lower wall, the plurality of leg positioning recesses is provided on the upper wall in such a manner that the plurality of leg positioning recesses is depressed toward the lower wall, and the plurality of wheel positioning recesses is provided on the lower wall in such a manner that the plurality of wheel positioning recesses is depressed toward the upper wall.

3. The tire-wheel transport structure according to claim 2, wherein the plurality of wheel positioning recesses is grooves respectively corresponding to the upper peripheries of the rims.

4. The tire-wheel transport structure according to claim 1, wherein the plurality of wheel positioning recesses is grooves respectively corresponding to the upper peripheries of the rims.

5. The tire-wheel transport structure according to claim 1, wherein bottom surfaces of the legs of the pallet are provided with engagement recesses, and the leg positioning recesses of the lid are provided with projections projecting upward and engageable with the engagement recesses.

* * * * *